United States Patent [19]

Raghavan et al.

[11] 4,213,799

[45] Jul. 22, 1980

[54] IMPROVING THE ELECTRICAL CONDUCTIVITY OF ALUMINUM ALLOYS THROUGH THE ADDITION OF MISCHMETAL

[75] Inventors: Mathur Raghavan, Norwalk; Stanley Shapiro, New Haven, both of Conn.; Ronald G. Hardy; Duncan G. Block, both of Hixson, Tenn.

[73] Assignee: Swiss Aluminium Ltd., Chippis, Switzerland

[21] Appl. No.: 912,205

[22] Filed: Jun. 5, 1978

[51] Int. Cl.[2] ..... C22F 1/04; C22C 21/00

[52] U.S. Cl. ..... 148/2; 75/141; 75/143; 148/11.5 A; 148/32

[58] Field of Search ..... 75/138, 141, 143; 148/11.5 A, 32, 32.5, 2

[56] References Cited

U.S. PATENT DOCUMENTS 3,278,300 10/1966 Kolke ..... 75/138

*Primary Examiner*—R Dean

*Attorney, Agent, or Firm*—Bachman and LaPointe

[57] ABSTRACT

The present invention utilizes the unique addition of mischmetal to aluminum base alloys to either enhance the conductivity of such alloys when compared to commercial conductor grade material or provide equivalent conductivity when utilizing grades of aluminum containing higher normal impurity levels. Various processing procedures can be utilized for this material, depending upon the desired final properties.

10 Claims, No Drawings

IMPROVING THE ELECTRICAL CONDUCTIVITY OF ALUMINUM ALLOYS THROUGH THE ADDITION OF MISCHMETAL

BACKGROUND OF THE INVENTION

Aluminum wire has been utilized for many years in such applications as overhead electricity transmission lines due to its desirable combination of relatively high conductivity and low weight. Since the most desirable attribute of such wire is the conductivity, the most popular form of aluminum for this purpose has been that alloy formerly known as EC aluminum and now known by its Aluminum Association Registration No. 1350. This particular aluminum alloy contains small amounts of silicon and iron in a high purity aluminum base to provide a wire of high conductivity but with higher strength than ultra-pure aluminum.

Unfortunately, since this particular aluminum alloy itself requires the use of a high purity aluminum as the base material for the alloy, products produced from this metal have tended to increase in cost so as to lower the benefit/cost ratio of aluminum over other materials.

Various other aluminum alloys have been formulated as replacement materials for Alloy 1350. For example, U.S. Pat. No. 3,278,300 discloses an aluminum base alloy containing iron and rare earth elements which is particularly useful for electrical conductors. This particular alloy system may also contain such elements as zirconium and magnesium. The particularly preferred rare earth elements are the combination of elements known as mischmetal. The influence of mischmetal upon aluminum alloy conductors is also discussed in an article by Venkatesan et al. in the September, 1970 issue of *Metallurgical Transactions* on Pages 2638–2641. In this article entitled "Effect of Misch Metal and Ferrocerium Additions on the Properties of 24 Gage Aluminum Wires", the addition of up to 3% mischmetal in aluminum increases the strength of the resulting alloy while decreasing its electrical conductivity. Above this 3% level, both the strength and conductivity properties suffer. The aluminum base may contain small percentages of Mn, Ti, V, Cr, Fe, Cu and Si. Mischmetal has also been contemplated as an addition to aluminum alloys for conductor applications and also for aluminum casting alloy applications as indicated in "Recent Applications of the Rare Earth Metals in Nonferrous Metallurgy" by I. S. Hirschhorn in the October, 1970 issue of the *Journal of Metals* on Pages 40–43. None of these particular references teaches the alloy system contemplated by the present invention.

Therefore, it is a principal object of the present invention to provide an alloy which exhibits higher electrical conductivity than commercially utilized aluminum.

It is a further object of the present invention to provide an alloy which presents equivalent conductivity to commercial aluminum alloys while utilizing lower purity grades of aluminum as the base material therein, such as commercial purity aluminum.

It is another object of the present invention to provide an alloy as aforesaid which exhibits high electrical conductivity properties while utilizing grades of aluminum in which some normal impurity levels of certain elements are enhanced for strength properties.

It is another object of the present invention to provide an alloy as aforesaid which improves the conductivity of conductor grade aluminum alloys in the cold worked, partially annealed or fully annealed condition.

Further objects and advantages of the present invention will become apparent from a consideration of the following specification.

SUMMARY OF THE INVENTION

The present invention utilizes the unique addition of mischmetal to aluminum base alloys to either enhance the conductivity of such alloys when compared to commercial conductor grade material or provide equivalent conductivity when utilizing grades of aluminum containing higher normal impurity levels. The addition of mischmetal acts as a "scavenging agent" in the aluminum base alloys to improve the conductivity of said alloys in either the cold worked, partially annealed or fully annealed condition.

DETAILED DESCRIPTION OF PREFERRED EMBODIMENTS

The unique properties of the alloy of the present invention are achieved by adding mischmetal from 0.001 to 1.0% by weight to an aluminum base alloy which contains from 0.001 to 1.0% by weight iron, from 0.001 to 0.2% by weight silicon, from 0.001 to 1.0% by weight copper, balance aluminum. The alloy may additionally contain from 0.001 to 0.2% by weight boron, up to 0.01% by weight for each of manganese and chromium and up to 0.05% by weight for zinc.

Alloys within these ranges to which the mischmetal addition is particularly suitable are those alloys which consist essentially of 0.001 to 0.4% by weight iron, 0.001 to 0.1% by weight silicon, 0.001 to 0.05% by weight copper, 0.001 to 0.01% by weight for each of manganese and chromium, 0.001 to 0.05% by weight zinc, balance aluminum and an alloy which consists essentially of from 0.04 to 1.0% by weight iron, 0.02 to 0.2% by weight silicon, 0.1 to 1.0% by weight copper, 0.001 to 0.2% by weight boron, balance aluminum. Another alloy which is especially suitable for improvement by the mischmetal addition is one which consists essentially of 0.5 to 1.0% by weight iron, 0.02 to 0.1% by weight silicon, 0.35 to 0.5% by weight copper, 0.001 to 0.2% by weight boron, balance aluminum.

It should be noted that the electrical conductivity of aluminum conductor alloys is significantly effected by both the level and nature of the impurities present in the alloys. Iron and silicon are very common impurity elements in aluminum alloys and have relatively reverse effects upon the electrical conductivity of said alloys. Iron has only a small effect upon the conductivity while silicon significantly impairs the conductivity of the alloys. Other impurities such as gallium and titanium are also detrimental to the electrical conductivity of such alloys. Therefore, since some of these impurity elements, when present in larger than normal impurity amounts within the alloy system, improve the strength of such alloys, any alloying additions which can improve the electrical conductivity of such high strength alloys are of particular importance. Such alloying additions permit additional solute strengthening with no apparent loss in electrical conductivity for the alloy. The present invention utilizes the addition of mischmetal as a scavenging agent to improve the conductivity of such aluminum conductor alloys in either the cold worked, partially annealed or fully annealed condition.

The processing of the alloy of the present invention will depend upon the final properties desired in products produced from said alloy. In all cases, the alloy may be cast in a conventional manner, such as Durville, direct-chill, continuous cast, and other methods. The as-cast billet or bar may optionally be homogenized at a temperature range of from 650° to 950° F. for ½ hour or more.

The billet or bar, whether homogenized or not, is then deformed at an elevated temperature above 400° F. and preferably above 600° F. up to approximately 950° F. This elevated temperature deformation step is important in obtaining the final desired properties within the alloy. When the alloy is being utilized for eventual wire applications, this elevated temperature deformation step will usually produce what is known as redraw rod. At this stage, the rod material may undergo a rod anneal at 400° to 600° F. for approximately 1 to 8 hours.

The alloy should then be cold deformed directly to whatever gage is desired, preferably in the range of 0.002 to 0.375". In those instances where high mechanical properties are desired, the material should be cold deformed to a reduction of at least 75% in area and preferably at least 90%. Of course, the amount of cold deformation required to achieve a given strength level will be dependent upon the particular alloy being worked and the hot deformation profile. The worked alloy may be subjected to a final holding step at 250° to 600° F. for from 1 to 8 hours, depending upon desired final properties.

The process of the present invention and the advantages obtained thereby may be more readily understood from a consideration of the following illustrative example. All percentages for the alloying additions will be in terms of weight percent.

EXAMPLE

Mischmetal (approximately 50% cerium, 25% lanthanum, 16% neodymium, 6% praseodymium and 3% other rare earth elements) additions of 0.50 and 0.1% were made to conductor grade aluminum Alloy 1350 which had fixed iron and silicon levels of 0.25% and 0.10%, respectively. Two thousand grams of each of these alloys were melted in an induction furnace, fluxed with Freon gas and cast into ingots using the Durville method. These ingots were then scalped and homogenized at 750° F. for 1.5 hours and were then hot worked at 750° F. to a redraw rod diameter of 0.375" with one reheating at 750° F. to avoid excessive heat loss in the process. These redraw rods were then cold drawn through several circular dies down to a wire having a diameter of 0.128" (AWG 8). The electrical conductivity of the wires were measured at this gage using a standard Kelvin Bridge. The tensile properties of these alloys were also measured and both the electrical conductivity and tensile results are shown in Table I. These results were compared to standard commercially available Alloy 1350 (identified in Table I as Alloy 3) at the same gage and the results for this material are also shown in Table I. The results indicate that the mischmetal addition increased the electrical conductivity of both alloys over that shown by Alloy 1350 without any significant effect upon the alloy containing 0.5% mischmetal. The other alloy exhibited a premature failure in the tensile testing procedure due to a poor quality wire. It should be noted that both the conductivity values and tensile properties of the alloys fully met the Aluminum Association's specifications for commercial Alloy 1350.

TABLE I

PROPERTIES OF MISCHMETAL MODIFIED ALUMINUM CONDUCTOR ALLOYS

| | Elements, Weight % | | | Electrical | Mechanical Properties** | |
|---|---|---|---|---|---|---|
| Alloy | Fe | Si | MM | Conductivity, % IACS* | UTS, ksi | % Elongation, (10") |
| 1 | 0.25 | 0.1 | 0.5 | 62.1 | 28.25 | — |
| 2 | 0.25 | 0.1 | 0.1 | 62.6 | 23.0*** | — |
| 3 | Minimum 99.5 Al | | | 61.0 | 28.0 | 1.3 |

*At AWG 8, approximately -H14 temper.
**At -H19 temper.
***Premature failure.

It can readily be seen from the example presented hereinabove that mischmetal presents unique advantages in increasing the electrical conductivity of aluminum base conductor grade alloys over such alloys as are now commercially utilized. The alloy system of the present invention also presents the advantage of attaining equivalent conductivity values with commercial materials while utilizing less expensive and less pure grades of aluminum as the base material in the alloys. Thus, it can be seen that the alloy system of the present invention presents unique advantages whether increased conductivity is sought or whether reduced costs are sought.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An aluminum base conductor wire having an electrical conductivity equivalent to commercial grade aluminum conductor wire consisting essentially of 0.04 to 1.0% by weight iron, 0.02 to 0.2% by weight silicon, 0.1 to 1.0% by weight copper, 0.001 to 0.2% by weight boron, 0.001 to 1.0% by weight mischmetal, balance essentially aluminum.

2. A process of forming an aluminum base conductor wire having an electrical conductivity equivalent to commercial grade aluminum conductor wire, said process comprising the steps of:

(a) casting an aluminum base alloy consisting essentially of 0.04 to 1.0% by weight iron, 0.02 to 0.2% by weight silicon, 0.1 to 1.0% by weight copper, 0.001 to 0.2% by weight boron, 0.001 to 1.0% by weight mischmetal, balance essentially aluminum;

(b) hot working said alloy at a temperature above 400° F. up to approximately 950° F.; and (c) cold working said alloy to a size range of 0.002 to 0.375".

3. An alloy according to claim 1 wherein said alloy contains up to 0.01% by weight for each of manganese and chromium and up to 0.05% by weight zinc.

4. An alloy according to claim 1 wherein said alloy consists essentially of 0.5 to 1.0% by weight iron, 0.02 to 0.1% by weight silicon, 0.35 to 0.5% by weight copper, 0.001 to 0.2% by weight boron, 0.001 to 1.0% by weight mischmetal, balance aluminum.

5. An alloy according to claim 1 exhibiting high electrical conductivity and high strength properties while utilizing commercial purity aluminum, wherein the mischmetal addition acts as a scavenging agent to improve the electrical conductivity of the alloy.

6. A process according to claim 2 wherein said alloy is homogenized at a temperature of from 650° to 950° F. for at least ½ hour prior to being hot worked.

7. A process according to claim 2 wherein said alloy is subjected to annealing at 400° to 600° F. for 1 to 8 hours after being hot worked but before being cold worked.

8. A process according to claim 2 wherein said alloy is cold worked to a reduction of at least 75% in area.

9. A process according to claim 2 wherein said cold worked alloy is subjected to a final holding step at 250° to 600° F. for from 1 to 8 hours.

10. A process according to claim 2 wherein said alloy contains up to 0.01% by weight for each of manganese and chromium and up to 0.05% by weight zinc.

* * * * *